United States Patent [19]

Renfroe

[11] 4,183,571

[45] Jan. 15, 1980

[54] SCREW-TYPE LIFTING CLAMP

[75] Inventor: Charles J. Renfroe, Jacksonville, Fla.

[73] Assignee: J. C. Renfroe and Sons, Inc., Jacksonville, Fla.

[21] Appl. No.: 765,376

[22] Filed: Feb. 3, 1977

Related U.S. Application Data

[63] Continuation-in-part of Ser. No. 664,043, Mar. 4, 1976, abandoned.

[51] Int. Cl.[2] ..... B66C 1/44

[52] U.S. Cl. ..... 294/101; 24/243 B; 269/271; 269/279; 294/103 R

[58] Field of Search ..... 294/101, 103 R, 104, 294/78; 269/249, 280, 281, 282, 283, 284, 271, 279; 24/243 B, 263 A

[56] References Cited

U.S. PATENT DOCUMENTS

| | | | |
|---|---|---|---|
| 2,792,731 | 5/1957 | Turner | 269/279 |
| 3,120,046 | 2/1964 | Olsen | 294/104 |
| 3,178,219 | 4/1965 | Renfroe | 294/104 |
| 3,269,766 | 8/1966 | Gardner | 294/101 |
| 3,403,901 | 10/1968 | Servadio | 269/284 |
| 3,947,011 | 3/1976 | Tsuyama | 294/101 |

FOREIGN PATENT DOCUMENTS

| | | | |
|---|---|---|---|
| 1148224 | 4/1969 | United Kingdom | 294/103 R |

*Primary Examiner*—Kenneth J. Dorner
*Attorney, Agent, or Firm*—Schuyler, Birch, McKie & Beckett

[57] ABSTRACT

A screw-type lifting clamp comprising a generally U-shaped clamp body having a pair of spaced, opposed projections defining a generally vertically downwardly facing material receiving slot, a lifting shackle attached to said clamp body, a screw threadedly received through a first such body projection and being threadedly movable toward and away from the second body projection, a jaw pivotally mounted to the second body projection for pivotable movement about a horizontal axis perpendicular to the screw axis, and resilient means urging the jaw to a horizontal position. The pivotable jaw includes vertically spaced teeth defining a gripping surface which is convex in a vertical plane and has a radius of curvature greater than the horizontal distance between the jaw pivotal axis and the jaw gripping surface when that jaw is horizontal.

16 Claims, 13 Drawing Figures

SCREW-TYPE LIFTING CLAMP

RELATED APPLICATION

This is a continuation-in-part of my copending application Ser. No. 664,043 filed Mar. 4, 1976 and now abandoned.

BACKGROUND OF THE INVENTION

The instant invention relates to a screw-type clamp suitable for lifting material such as metal plates.

The prior art contains numerous types of clamps suitable for lifting metal plates. The majority of these prior art clamps incorporate one generally fixed jaw and another movable jaw which may be brought into contact with the material to be lifted. The movable jaw has generally been activated by means of a lever or similar structure.

A few of the prior art devices have incorporated a threaded shaft for advancing one jaw into engagement with the material to be clamped, as illustrated in Sherwood U.S. Pat. No. 2,548,401 and Gardner U.S. Pat. No. 3,269,766. However, these prior art devices have suffered several significant disadvantages in operation. Devices such as disclosed in the Sherwood patent, having one rigidly fixed jaw and a second jaw capable only of threaded axial movement, have suffered from an inability to be tightened sufficiently against the material to be carried, so that such clamps are usable only for lifting relatively light loads. Devices such as disclosed in the Gardner patent have overcome some of these lifting limitations by incorporating one jaw which is capable of limited translational movement vertically within the slot and a second jaw which is attached by a ball and socket joint to the end of the clamping screw and which includes a toothed, convexly curved face. However, when a load is applied to the Gardner structure, as during lifting, the rotation of the convexly faced jaw about its ball and socket mounting to grip the lifted plate more securely causes the point of application of the force between the plate being lifted and the screw to move away from the axis of the screw, thus creating a bending moment on the screw. Due apparently to the imposition of this bending moment, it has been found in practice that the screw tends to bind within its threads thus making subsequent release of the clamp very difficult when significant lifting loads have been applied.

SUMMARY OF THE INVENTION

It is an object of this invention to provide a screw-type lifting clamp which is capable of gripping and securely holding heavy loads while providing for easy release of the clamp after the lifting forces have been removed.

Briefly, the invention contemplates a screw-type clamp for lifting material, such as metal plates, comprising a clamp body having generally an inverted U-shaped configuration when in a normal vertical lifting orientation, with opposed first and second projections defining a generally vertically downwardly facing material receiving slot therebetween which is open at its outer end, and which includes a lifting shackle for lifting the clamp, the shackle being attached to the clamp body adjacent the inner end of the slot and extending generally vertically upwardly from the clamp body. A screw is threadedly received through a first said body projection for rotation about a horizontal axis, the screw having a first end fixed against vertical movement and defining a material gripping surface extending into the slot toward the second said body projection, such screw being threadedly movable horizontally toward and away from the second body projection. A jaw is mounted to the second body projection and includes vertically spaced teeth defining a material gripping surface extending into the slot and opposing the screw gripping surface so that threaded movement of the screw toward the jaw urges material in the slot into a gripping relationship between the gripping surfaces of the jaw and the screw. This jaw is pivotable about a horizontal axis perpendicular to the screw axis to move the jaw gripping surface upwardly and downwardly in the slot, the jaw gripping surface being convex in a vertical plane and having a radius of curvature greater than the horizontal distance between the jaw pivotal axis and the jaw gripping surface when the jaw is horizontal, so that the jaw teeth bite into the material when the jaw is pivoted downwardly by the weight of the material upon application of a lifting force to the shackle. Resilient means is connected between the clamp body and the pivotable jaw to cause the pivotable jaw to assume a horizontal position when not in contact with material to be lifted.

BRIEF DESCRIPTION OF THE DRAWINGS

The invention having been generally described, specific embodiments thereof will be discussed in detail with reference to the accompanying drawings in which.

DESCRIPTION OF PREFERRED EMBODIMENTS

Figure 1:
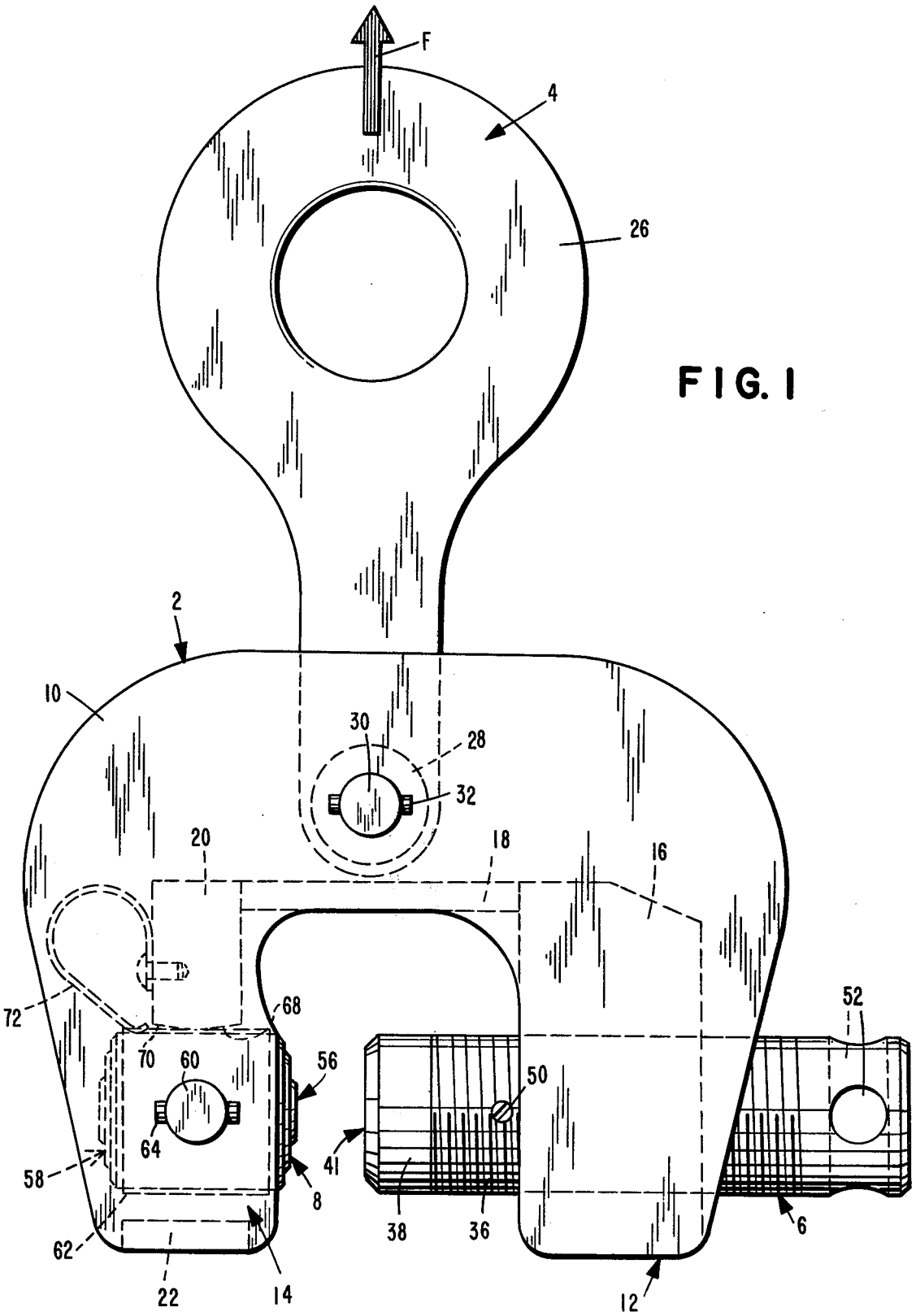
FIG. 1 is a side elevation of one embodiment of the clamp of this invention.

In the embodiment of FIG. 1, the basic components of the clamp include the generally U-shaped clamp body 2, a lifting shackle pivotally connected to the body 2, a screw 6 threadedly received through a portion of the body 2, and a jaw 8 pivotally mounted to the body 2 opposing the screw 6. In FIG. 1 and in all other illustrations the clamp is shown in its normal vertical lifting orientation.

The clamp body 2 conveniently may be fabricated of generally U-shaped, plate members 10, defining a first projection 12 and a second projection 14 which, in turn, define a generally vertically downwardly facing slot therebetween. The two plate members 10 are spaced apart and joined by screw block 16, rear body spacer 18, jaw angle block 20, and front spacer block 22. Each of these blocks is joined to the body side plates 10 by a suitable means, such as weldments.

Lifting shackle 4 conveniently may include shackle eye 26 and has bosses 28 welded to either side to provide additional support for the pivotal connection of the lifting shackle to the clamp body by means of shackle pin 30 extending therethrough. Suitable retaining pins, such as roll pins 32, may be provided adjacent the ends of shackle pin 30 to retain the shackle pin 30 in place. Obviously, other types of lifting shackles such as chains, cables and the like and other mountings may be used with equally satisfactory results.

Figure 3:
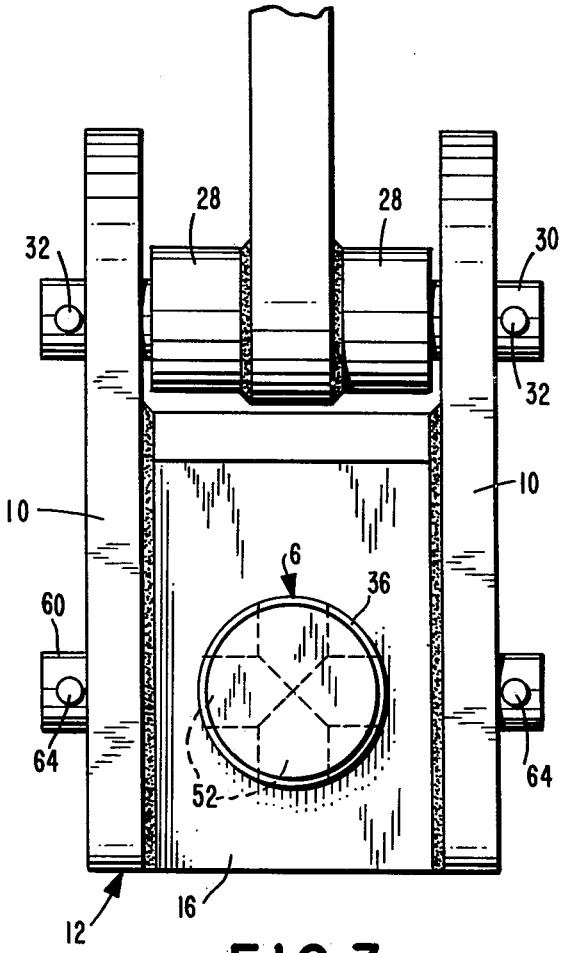
FIG. 3 is a partial end elevation of the clamp of FIG. 1, illustrating the right end of the clamp as oriented in FIG. 1.
Figure 4:
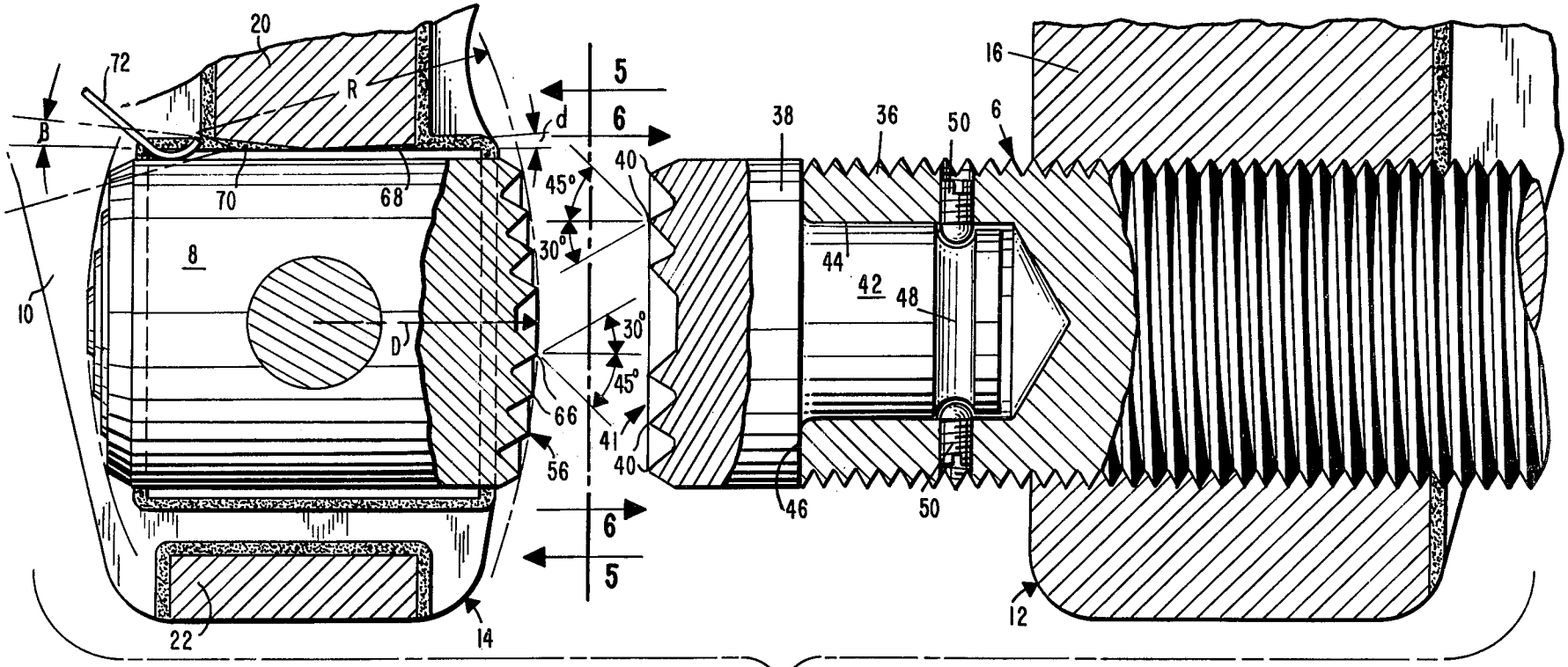
FIG. 4 is an enlarged view, partially in section, of the jaw and screw portions of the clamp of FIG. 1.
Figure 6:
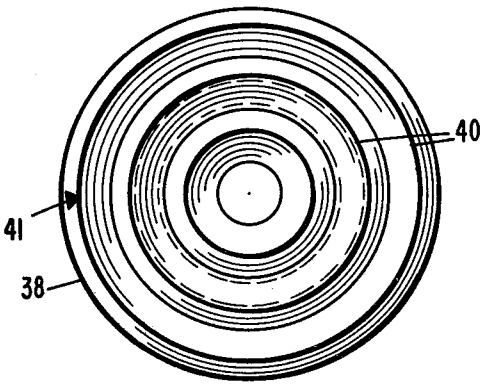
FIG. 6 is an end view of the screw of FIG. 4, taken along line 6—6.

As illustrated in FIGS. 1, 3 and 4, screw block 16 forming a part of first body projection 12 is bored and internally threaded to threadedly receive screw 6 horizontally therethrough. Screw 6 comprises, generally, a threaded shaft 36 having screw jaw 38 attached to the innermost end 46 of shaft 36 and fixed against vertical movement. The axially innermost portion of jaw 38, also illustrated in FIG. 6, includes a plurality of vertically spaced teeth 40 defining a material gripping surface 41, the teeth preferably being in the form of circular ridges which are concentric with the screw shaft 36. It has been found desirable to form these teeth 40 with the angles indicated in FIG. 4, the radially inner surfaces sloping outwardly 45° from the axis of the screw and the radially outer sides of the teeth sloping inwardly at 30° from the same axis. The portion of the jaw axially opposite the material gripping surface 41 includes a section of reduced diameter 42 which is rotatably received within a bore 44 extending inwardly of the innermost end 46 of the shaft 36. Adjacent the end of portion 42 axially remote from the gripping surface is an annular groove 48. A pair of ball-ended set screws 50 are threaded radially inwardly of the threaded shaft 36 at diametrically opposed locations such that they project into the groove 48 of the screw jaw 38 to restrain axial movement of the jaw 38 while permitting it to rotate or swivel about its axis. Thus, when the screw 6 is advanced to bring the teeth 40, and thus material gripping surface 41, into a gripping relationship with material such as a steel plate in the slot, the jaw 38 may nonrotatably grip the material while the threaded shaft 36 continues to be threaded towards such material.

At the end of shaft 36 opposite the jaw 38 there conveniently may be provided a bore 52, or preferably a pair of intersecting bores 52, extending diametrically through the shaft 36 to receive a rod or other structure to facilitate rotation of the shaft 36 by increasing the mechanical advantage of the user.

Figure 2:
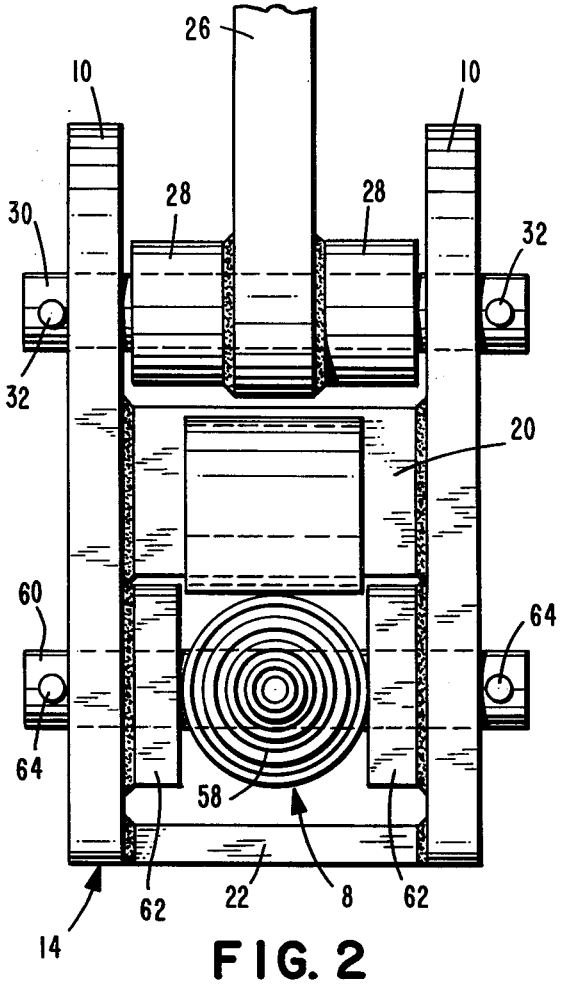
FIG. 2 is a partial end elevation of the clamp of FIG. 1, illustrating the left end of the clamp as oriented in FIG. 1.
Figure 5:
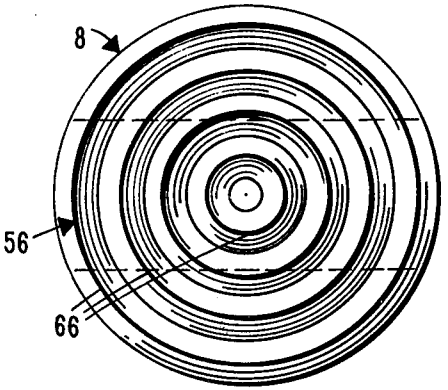
FIG. 5 is an end view of the pivotable jaw of the clamp of FIG. 4, taken along line 5—5.

Pivotable jaw 8 opposing the screw 6 may be seen most clearly in FIGS. 2 and 5 and on the left side of FIG. 4. In this embodiment the jaw 8 is of generally cylindrical configuration having axially opposed gripping surfaces 56 and 58 which are essentially identical to one another. This jaw 8 is pivotally mounted to the second body projection 14 by a pin 60 extending through side plates 10 and diametrically through the jaw 8. To provide additional support for pivot pin 60, bosses 62 may desirably be welded to the insides of plates 10, with the pin 60 also passing therethrough. Axial movement of pin 60 may be restrained by insertion of roll pins 64 therethrough, adjacent the ends of pin 60.

The gripping surface 56 (and 58) of pivotable jaw 8 is defined by a plurality of vertically spaced teeth 66, illustrated in FIG. 4, arranged such that the progressively outer teeth (with respect to the jaw axis) are set back to form a gripping surface which is convex in a vertical plane. The radius of curvature R of this convex material gripping surface 56 (or 58) is greater than the horizontal distance D between the jaw pivotal axis, defined by pivot pin 60, and the jaw gripping surface 56 when the jaw is horizontal, as illustrated in FIG. 4. Preferably, this radius of curvature R is between four and seven times the distance D. As illustrated in the end view of this jaw 8 in FIG. 5, the jaw teeth 66 of this embodiment preferably are in the form of concentric, circular ridges with the material gripping surface thus being spherically convex. The second material gripping surface 58 is preferably of identical configuration and dimensions. As with the teeth of screw jaw 38, it has been found advantageous to configure the teeth of pivotable jaw 8 such that the radially inner sides of the teeth slope outwardly at approximately 45° with respect to the jaw axis and the radially outer sides of the teeth slope inwardly at approximately 30° with respect to the jaw axis.

While jaw 8 is mounted for pivoting movement about pin 60, such pivoting is limited by stops incorporated into jaw angle block 20. The stops are formed by angled surfaces 68 and 70 extending transversely of the angle block 20 and located, respectively, inwardly and outwardly of the clamp with respect to the axis of pin 60. It has been found advantageous to configure surface 68 at an angle $\alpha$ not greater than 10° with respect to the axis of screw 6 and preferably between 2° and 5°. It is also desirable to limit the angle $\beta$ of surface 70, with respect to the axis of screw 6, to not more than about 15° and preferably within the range of 6° to 10°. These angles permit the jaw 8 to pivot sufficiently to function in the manner to be described below while preventing excessive pivoting, which may cause accelerated wear on the jaw teeth. Also for reasons to be described more fully below, it frequently has been found advantageous to incorporate a resilient means such as leaf spring 72 to urge the pivotal jaw, when not in contact with material to be lifted, to assume a position between horizontal and pointing pivotally upwardly in the slot. Preferably the pivotal jaw 8 is retained by the spring 72 in the position illustrated in FIG. 4 in which the jaw 8 is horizontal and with the circular teeth of the gripping surface 56 coaxial with the circular teeth of the gripping surface 41 of screw 6.

When it is desired to lift material, such as a steel plate, by the clamp of this invention, the manner of operation and use is generally as follows: The edge of the plate is introduced into the slot defined by the opposed body projections 12 and 14 and is positioned between screw jaw 38 and pivotable jaw 8, which preferably is axially aligned with the screw 6. Then, by hand or by means of a rod or other member inserted through the bore 52 in the outer end of threaded shaft 36, screw 6 is threadedly advanced toward the steel plate in the slot and urges that plate into a gripping relationship between the gripping surface 56 of the pivotable jaw 8 and the gripping surface 41 defined by the teeth 40 of screw jaw 38. The screw 6 need only be firmly hand tightened. At this point the plate gripped by the jaws generally will be contacted by all of the teeth 40 of the screw jaw 38 but only by the radially innermost teeth 66 of the pivotable jaw 8. However, upon application to the shackle 4 of a lifting force in the vertical direction as indicated by the arrow in FIG. 1, the weight of the plate gripped by screw jaw 38 and pivotable jaw 8 will tend to pivot jaw 8 downwardly about its pin 60, thus bringing progressively upper teeth 66 in gripping contact with the plate. Since the radius of curvature of the gripping surface 56 of jaw 8 is greater than the distance from the pivot axis of that jaw to the gripping surface, this pivoting will effect a firm, camming action by the jaw, urging those progressively upper teeth 66 into firmer gripping engagement with the plate. Significantly, it should be noted that the pivoting movement of jaw 8 is relatively slight, and that no provision is made for movement of screw jaw 38 vertically within the slot. Accordingly, when the lifting force on the shackle 4 is removed, as when the lifted plate is again set down, any bending moments created by the weight of the plate acting on the screw 6 are substantially relieved, such that the remaining forces on that screw, and more particularly upon the screw threads, are essentially axial in direction and cause very little binding of the screw 6 within the block 16. Thus, the screw 6 may easily be threaded outwardly to withdraw the gripping surface 41 of jaw 38 from engagement with the steel plate to release the clamp from the plate. Frequently, the screw may be withdrawn by hand, although the use of a rod or the like inserted in the bore 52 may be desirable.

While the clamp of this embodiment has been illustrated with preferred concentric, circular teeth defining the gripping surfaces, it may be noted that straight, horizontal teeth would function equally satisfactorily for purposes of gripping and lifting. However, if the plate being lifted were caused to swing about the axis of the screw 6, such straight teeth might tend to cause the clamp to "walk" on the plate or to tear the surface of the plate while the illustrated concentric, circular teeth tend to form only minor circular marks. Thus, the initial coaxial orientation of the circular gripping teeth of the jaws 8 and 38 is especially advantageous.

It may be noted that the principal load upon the gripping surface 56 of the pivotal jaw 8 is born by the vertically upper teeth, as described above, while little or no load is exerted upon the vertically lower teeth. Accordingly, in repeated usage it is likely that such upper teeth will eventually wear and become dull. In such an event, the pins 64 and 60 may be withdrawn from the clamp and the jaw 8 rotated 180° about its axis to place the previously lower teeth of the gripping surface 56 in the upper position, thereby renewing the effective portion of the gripping surface 56. Additionally, as described above, a second gripping surface 58 is provided on the end of jaw 8 axially opposed to gripping surface 56. This gripping surface 58 desirably may be identical in configuration and dimension to gripping surface 56. Thus, when gripping surface 56 has become worn down, the jaw 8 may be reversed end-for-end in its pivotal mounting, again by withdrawing and replacing the pivot pin 60, thus providing a fresh and sharp-toothed gripping surface 58 for the jaw. If the teeth 40 defining the gripping surface of the screw jaw 38 become worn, the set screws 50 retaining that jaw in the end of shaft 36 may be withdrawn and a new-sharp-toothed jaw 38 inserted therefor and similarly retained.

Figure 7:
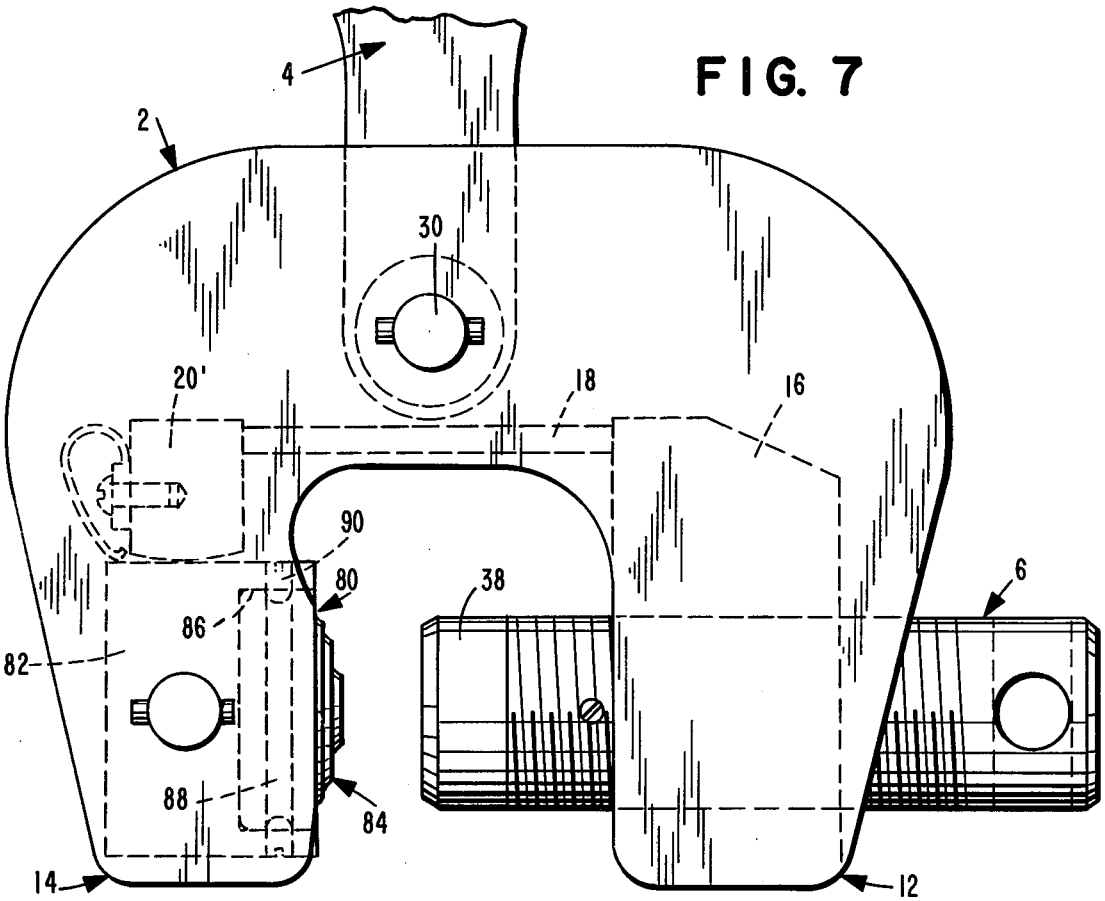
FIG. 7 is a partial side elevation of a second embodiment of the clamp of this invention.
Figure 8:
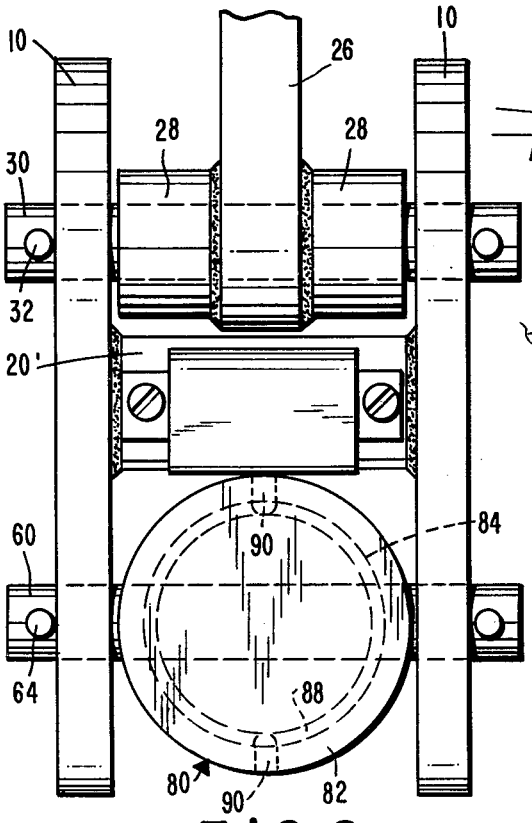
FIG. 8 is a partial end elevation of the clamp of FIG. 7, illustrating the left end of the clamp as oriented in FIG. 7.
Figure 9:
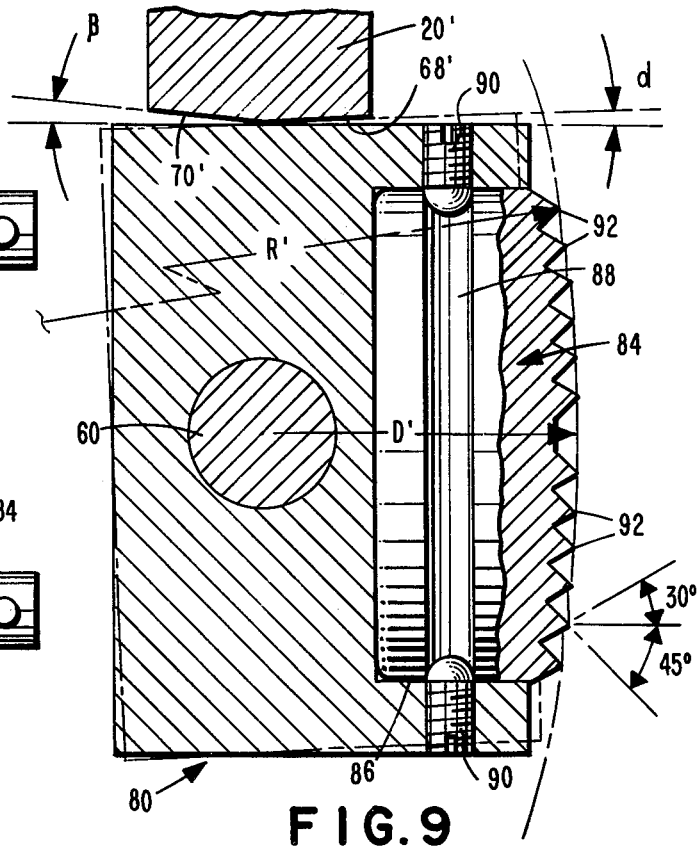
FIG. 9 is an enlarged side sectional view of the pivotable jaw of the clamp of FIG. 7.

A second desirable embodiment of the clamp of this invention is illustrated in FIGS. 7 through 9. Except for the structure of the pivotable gripping jaw and the deletion of front block 22 and bosses 62, this second embodiment of the clamp is essentially identical with that described above. Accordingly, only the structure associated with the pivotable gripping jaw will be described in further detail.

Whereas the pivotable jaw 8 of the previous embodiment may be a unitary structure, the pivotable jaw 80 of FIGS. 7 through 9 includes both a pivot body 82 and a toothed insert 84 removably attached to the pivot body 82. As illustrated in FIG. 9, the pivot body 82 includes, in the end facing the screw 6, a bore 86 dimensioned to receive snugly the insert 84. The insert 84 is provided with an annular groove 88 into which project a pair of diametrically opposed set screws 90, projecting through pivot block 82 and securing insert 84 thereto. The portion of insert 84 facing inwardly of the material receiving slot includes a plurality of vertically spaced teeth 92 defining a jaw gripping surface which is convex in a vertical plane and is substantially similar to the gripping surface 56 defined by the teeth 66 of jaw 8 in the previously described embodiment. As with the previously described embodiment, the radius of curvature R′ of the jaw gripping surface is greater than the horizontal distance between the jaw pivotal axis, defined by pivot pin 60, and the jaw gripping surface when the jaw is horizontal. Again, the radius of curvature R′ is preferably four to seven times the distance D′. This embodiment also includes angled surfaces 68′ and 70′ associated with the jaw angle block 20′ to limit the pivotal movement of jaw 80 to the above described angles $\alpha$ and $\beta$.

As is apparent, the principal advantages of this second embodiment over the first embodiment relate to the rotatable insert 84 forming the material gripping surface of jaw 80. With this structure the insert may be rotated as portions of the teeth 92 wear to distribute the wear evenly around the concentric, circular teeth. Further, when the teeth of the insert have become substantially worn out, the insert may easily be removed and replaced to provide a new, sharp-toothed material gripping surface. Moreover, the combination of the initial coaxial orientation of the insert 84 and the jaw 38 and the fact that both the insert 84 and the jaw 38 are pivotable about their own axis minimizes the danger that a plate gripped between the jaws will "walk" out of the clamp's grip when it is caused to swing. In other respects, the clamps of both embodiments are essentially identical.

Figure 10:
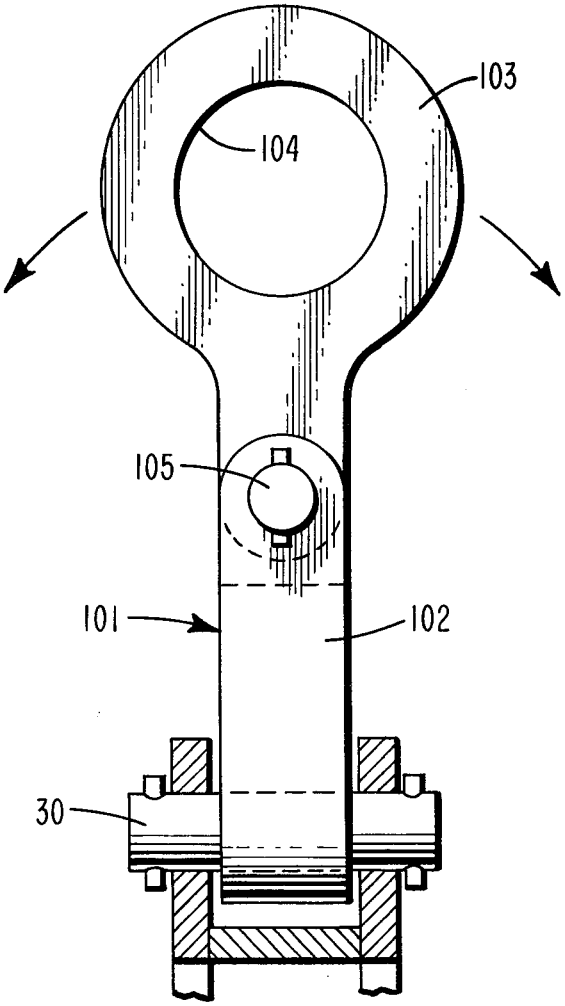
FIG. 10 is a fragmentary view, partially in section, illustrating a modified form of shackle mounted on a clamp of this invention.
Figure 11:
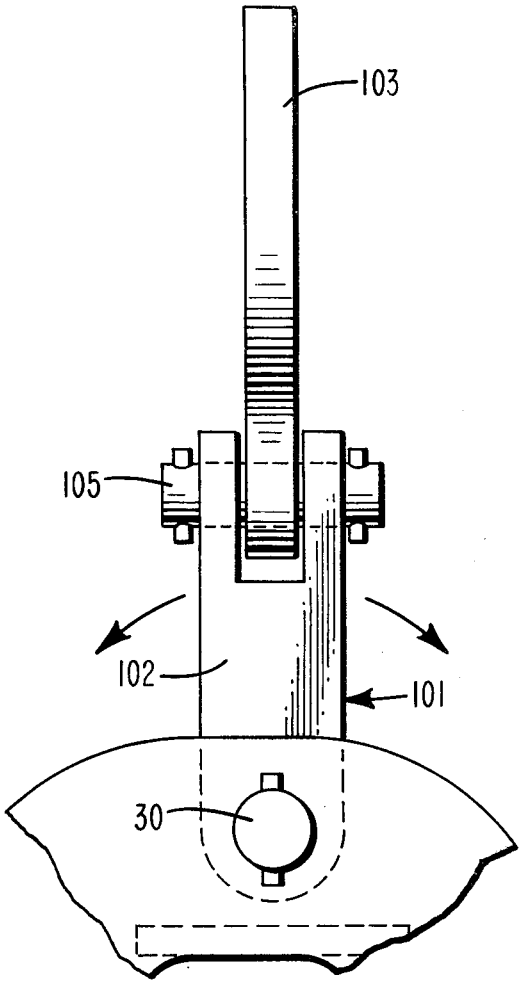
FIG. 11 is a fragmentary side elevation illustrating the shackle of FIG. 10.

Illustrated in FIGS. 10 and 11 is an alternative two-part shackle construction which may be employed with either of the clamp embodiments heretofore described. The modified shackle 101 includes a lower member 102 and an upper member 103. The lower member 102 is mounted on the pivot pin 30 of any of the clamp embodiments as heretofore described. The upper member 103 has a lifting eye 104 and is pivotally connected to the lower member 102 by a pin 105. The axis of the pin 105 is parallel to the axis of the screw 6 and the pivoted jaw 8 or 80. The pivot pin 30 is mounted directly above the slot defined by the projections 12 and 14. Thus, when the clamp is lifted by the shackle 101, the clamp and the load carried thereby are free to swing in the general plane of the clamp body about the pivot pin 30 or in a plane perpendicular to the clamp body about the pivot pin 105. The shackle eye 104 has an axis which is parallel to the clamp body whereas the shackle eye of the shackle 4 has an axis which is perpendicular to the clamp body.

Figure 12:
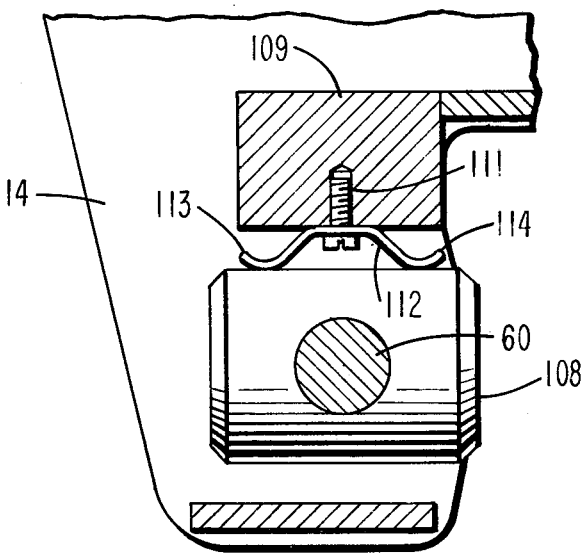
FIG. 12 is a fragmentary sectional view illustrating a modified form of spring for positioning the pivotable jaw.
Figure 13:
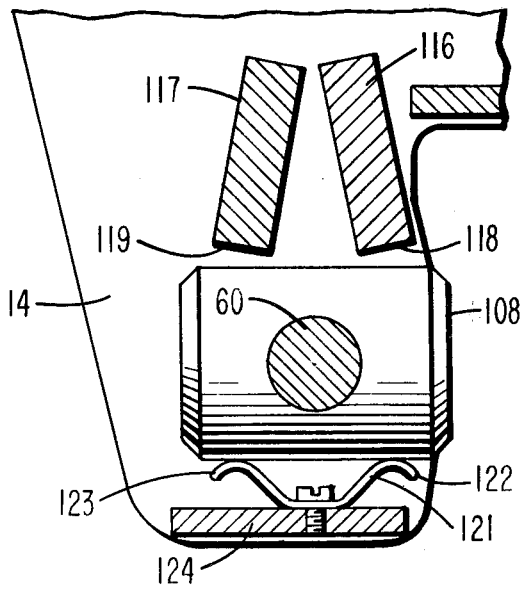
FIG. 13 is a fragmentary sectional view illustrating another modified form of spring for positioning the pivotable jaw.

Illustrated in FIGS. 12 and 13 are modified spring devices for resiliently urging the pivoted jaw toward an initial horizontal position. Specifically, FIG. 12 discloses a clamp body projection 14 having a pivot pin 60 on which is mounted a pivoted jaw 108 which may be identical to either the jaw 8 or the jaw 80. A jaw block 109 is mounted between the side plates of the clamp body and has connected thereto by a threaded fastener 111, a leaf spring 112 having curved ends 113 and 114 engaging the jaw 108 on opposite sides horizontally of the pivot pin 60. The spring ends 113 and 114 resiliently urge the jaw 108 to a horizontal position with the concentric circular teeth on the face of the jaw 108 facing and coaxial with the circular teeth of the screw 6 which is not shown.

A slightly modified form of spring and stop arrangement for the pivoted jaw is shown in FIG. 13. That embodiment includes a clamp body projection 14, a pivot pin 60 and a pivoted jaw 108 identical to that disclosed in FIG. 12. Dual jaw blocks 116 and 117 are affixed to the clamp body and have lower surfaces 118 and 119 which function as stops for the jaw 108. The surfaces 118 and 119 have the same angular relationship to the pivoted jaw as the stop surfaces 68 and 70 shown in FIGS. 1 and 4. A leaf spring 121 having curved ends 122 and 123 is mounted below the jaw 108 and connected to a spacer block 124 which is mounted between the clamp body plates at the bottom of clamp projection 14. The leaf spring ends 122 and 123 resiliently engage the pivoted jaw 108 to maintain it in the same horizontal initial position coaxial with the screw as described with respect to the corresponding leaf spring of FIG. 12. In this instance, the spring 121 is located below pivot 60 with the spring ends 122 and 123 engaging the bottom surface of the pivoted jaw 108 on opposite sides horizontally of the pivot pin 60.

While preferred embodiments of the clamp of this invention have been described above in detail, this description is intended only to be illustrative and not limiting since numerous variations, all within the scope of this invention, may be made. Thus, the invention is to be limited solely by the claims appended hereto.

I claim:

1. A screw-type clamp for lifting material such as metal plates, comprising:

a clamp body having generally an inverted U-shaped configuration when in normal vertical lifting orientation with spaced, opposed first and second projections defining a generally vertically downwardly facing material receiving slot therebetween open at its outer end;

a lifting shackle for lifting said clamp, attached to said clamp body adjacent the inner end of said slot and extending generally vertically upwardly from said body;

a screw having a shaft threadedly received through the first said body projection for rotation about a first horizontal axis, said screw having a first end fixed against vertical movement and defining a material gripping surface extending into said slot toward the second said body projection, said screw being threadedly movable horizontally toward and away from said second body projection;

a jaw mounted to said second body projection and having vertically spaced teeth defining a material gripping surface extending into said slot and opposing said material gripping surface of said screw so that threaded movement of said screw toward said jaw urges material in said slot into a gripping relationship between the material gripping surfaces of said jaw and said screw, said jaw being pivotable about a second horizontal axis perpendicular to and intersecting said screw axis to move said material gripping surface of said jaw upwardly and downwardly in said slot, said material gripping surface of said jaw being arcuately convex in a vertical plane, said jaw having a horizontal initial position at which said arcuate gripping surface extends furthest into said slot at a point along said first horizontal axis and recedes horizontally from said point uniformly above and below said first horizontal axis, said radius of curvature being greater than the horizontal distance between said jaw pivotal axis and said material gripping surface of said jaw when said jaw is horizontal, so that the jaw teeth bite into the material when said jaw is pivoted downwardly by the weight of the material upon application of a lifting force to the shackle; and resilient means connected between said clamp body and said pivotable jaw to resiliently urge said pivotable jaw in both rotational directions toward said horizontal initial position to cause said pivotable jaw to assume said horizontal initial position when not in contact with material to be lifted and to resist rotation of said pivotable jaw in either direction from said horizontal initial position.

2. A screw-type clamp according to claim 1 further comprising stop means defining limits of the pivoting of said pivotable jaw about said horizontal axis.

3. A screw-type clamp according to claim 2 wherein said pivotable jaw pivoting limits are not more than 10° either side of horizontal.

4. A screw-type clamp according to claim 1 wherein said material gripping surface of said screw comprises a jaw having vertically spaced teeth and being mounted for swivelling movement coaxially with said screw so that said screw jaw may remain rotationally stationary while being advanced by rotation of said screw into a gripping relationship with material in said slot.

5. A screw-type clamp according to claim 4 wherein said screw jaw teeth comprise a plurality of concentric, circular teeth.

6. A screw-type clamp according to claim 1 wherein said jaw gripping surface is generally spherically convex and said teeth on said pivotable jaw comprise a plurality of concentric, circular teeth.

7. A screw-type clamp according to claim 6 wherein the portion of said pivotably mounted jaw having said teeth comprises an insert removably attached to said jaw, whereby, upon dulling of the gripping teeth, the insert may be removed from the jaw and replaced by another such insert.

8. A screw-type clamp according to claim 7 further comprising means for attaching said insert to said pivotable jaw and providing for rotation of said insert coaxially with said screw when said pivotable jaw is horizontal.

9. A screw-type clamp according to claim 1 wherein said pivotable jaw mounting comprises a pin extending transversely through said second body projection and through said jaw.

10. A screw-type clamp according to claim 1 wherein said radius of curvature of said pivotable jaw gripping surface is between four and seven times said horizontal distance between said jaw pivotal axis and said jaw gripping surface when said jaw is horizontal.

11. A screw-type clamp according to claim 1 wherein the portion of said pivotable jaw remote from said jaw gripping surface includes vertically spaced teeth defining a second material gripping surface which is convex in a vertical plane with a radius of curvature greater than the horizontal distance between said jaw pivotal axis and said second material gripping surface when said jaw is horizontal so that, by reversal of said jaw in its pivotal mounting, said second material gripping surface may be substituted for said jaw material gripping surface.

12. A screw-type clamp according to claim 1 wherein said resilient means engages said pivotable jaw on opposite sides of said horizontal axis of said pivotable jaw.

13. A screw-type clamp according to claim 1 wherein said shackle comprises an inner member having a first pivotal connection to said body for rotation about a third horizontal axis parallel to said second horizontal axis and an outer member having a second pivotal connection to said inner member for rotation about a fourth horizontal axis perpendicular to said third horizontal axis, said first and second pivotal connections comprising the only pivotal connections for said shackle.

14. A screw-type clamp according to claim 6 wherein the portion of said jaw having said concentric, circular teeth comprises an insert rotatable about the axis of said circular teeth, said material gripping surface of said screw comprises a jaw having circular teeth and mounted in the screw for rotation about the axis of the screw, said circular teeth of said pivotable jaw and said circular teeth of the screw jaw being in mutually facing coaxial relationship when said pivoted jaw is horizontal.

15. A screw-type clamp for lifting material such as metal plates, comprising:

a clamp body having generally an inverted U-shaped configuration when in normal vertical lifting orientation with spaced, opposed first and second projections defining a generally vertically downwardly facing material receiving slot therebetween open at its outer end;

a lifting shackle for lifting said clamp, attached to said clamp body adjacent the inner end of said slot and extending generally vertically upwardly from said body;

a screw having a shaft threadedly received through the first said body projection for rotation about a first horizontal axis, said screw having a first end fixed against vertical movement and having circular tooth means concentric with said first horizontal axis defining a material gripping surface extending into said slot toward the second said body projection, said screw being threadedly movable horizontally toward and away from said second body projection;

a jaw mounted to said second body projection and having a plurality of concentric circular teeth defining a material gripping surface extending into said slot and opposing said material gripping surface of said screw so that threaded movement of said screw toward said jaw urges material in said slot into a gripping relationship between the material gripping surfaces of said jaw and said screw, said jaw being pivotable about a second horizontal axis perpendicular to and intersecting said screw axis to move said material gripping surface of said jaw upwardly and downwardly in said slot, said material gripping surface of said jaw being generally spherically convex, said jaw having a horizontal initial position at which said circular teeth on said jaw are coaxial with said circular tooth means on said screw, said spherically convex surface having a radius of curvature greater than the horizontal distance between said jaw pivotal axis and said spherically convex surface when said jaw is horizontal, so that the jaw teeth bite into the material when said jaw is pivoted downwardly by the weight of the material upon application of a lifting force to the shackle; and resilient means connected between said clamp body and said pivotable jaw to resiliently urge said pivotable jaw in both rotational directions toward said horizontal initial position to cause said pivotable jaw to assume said horizontal initial position when not in contact with material to be lifted and to resist rotation of said pivotable jaw in either direction from said horizontal initial position.

16. A screw-type clamp according to claim 15 wherein said shackle comprises an inner member having a first pivotal connection to said body for rotation about a third horizontal axis parallel to said second horizontal axis and an outer member having a second pivotal connection to said inner member for rotation about a fourth horizontal axis perpendicular to said third horizontal axis, said first and second pivotal connections comprising the only pivotal connections for said shackle.

* * * * *